US006312272B1

(12) United States Patent
Gaupp et al.

(10) Patent No.: US 6,312,272 B1
(45) Date of Patent: Nov. 6, 2001

(54) LEVER ACTUATED ELECTRICAL CONNECTOR

(75) Inventors: Peter Gaupp, Leinfelden-Echterdingen; Andreas Krull, Langen; Dietrich Wilhelm Kuempel, Ginsheim, all of (DE)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/520,622

(22) Filed: Mar. 7, 2000

(51) Int. Cl.[7] ..... H01R 13/62
(52) U.S. Cl. ..... 439/157
(58) Field of Search ..... 439/152–155, 439/157, 310, 372, 341–343

(56) References Cited

U.S. PATENT DOCUMENTS

| | | | | |
|---|---|---|---|---|
| 4,761,141 | * | 8/1988 | Hawk et al. | 439/153 |
| 5,320,544 | * | 6/1994 | Naoto et al. | 439/157 |
| 5,368,496 | * | 11/1994 | Ranalletta et al. | 439/372 |
| 5,393,238 | * | 2/1995 | Saito | 439/157 |
| 5,463,912 | | 11/1995 | Inoue et al. | 74/519 |
| 5,597,315 | * | 1/1997 | Taguchi | 439/157 |
| 5,785,540 | * | 7/1998 | Jaklin | 439/157 |
| 6,129,567 | * | 10/2000 | Gaupp et al. | 439/157 |

FOREIGN PATENT DOCUMENTS

| | | | |
|---|---|---|---|
| 0 618 646-B1 | 7/1998 | (EP) | H01R/13/629 |

* cited by examiner

*Primary Examiner*—Gary Paumen
*Assistant Examiner*—Ross Gushi

(57) ABSTRACT

An electrical connector comprising an actuating lever for mating the electrical connector with a complementary connector, the actuating lever including a deflectable lever leg with a pivot hole therethrough; and a connector housing having a wall with a pivot pin extending therefrom and being receivable within the hole of the lever leg to establish a pivot for the actuating lever; characterised in that: guide members and cams aligned with the pivot pin are included as part of the connector housing; and guide surfaces and camming surface on the actuating lever that are complementary to the respective guide members and cams of the connector housing such that the hole is aligned with the pin and an end of the leg is deflected over the pin, the lever further including a relief feature so that the lever can be operated once the pivot pin is received in the hole.

3 Claims, 4 Drawing Sheets

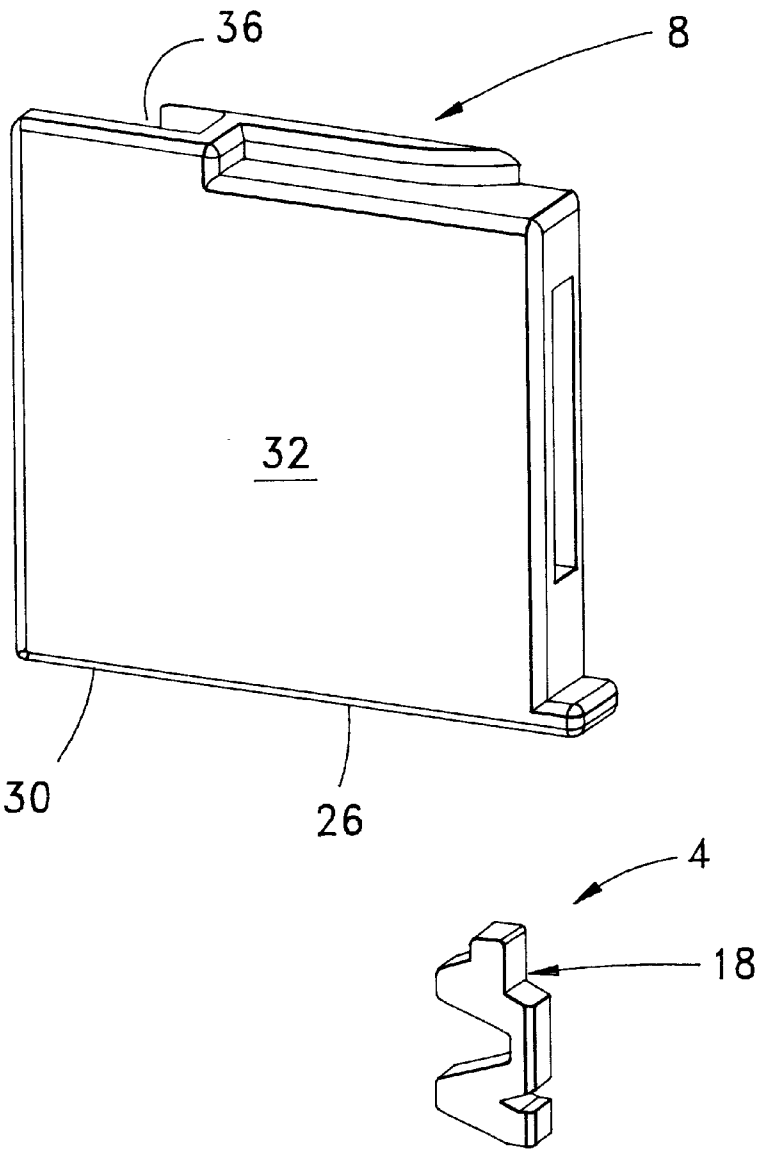
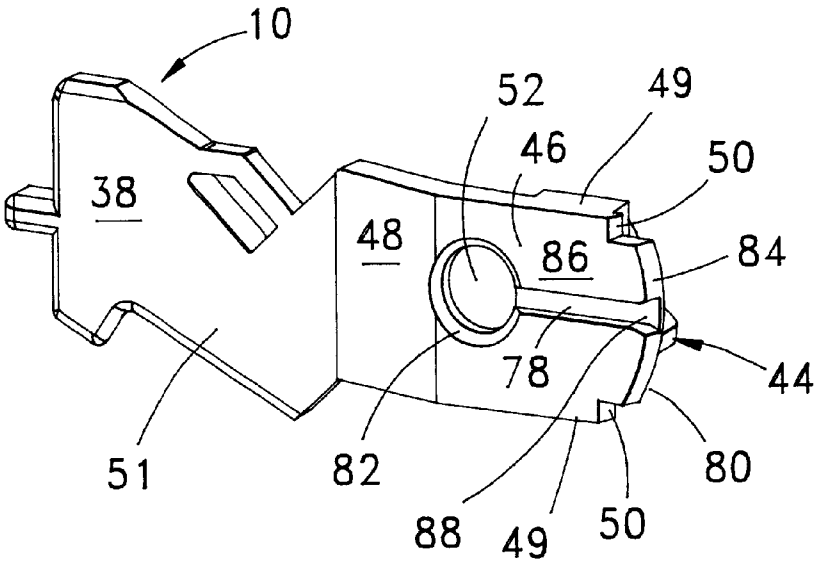
FIG. 7

LEVER ACTUATED ELECTRICAL CONNECTOR

BACKGROUND OF THE INVENTION

1. Field of the Invention

This invention relates to electrical connectors that utilize a lever actuation mechanism and in particular to improving the assembly of the actuating lever to the connector.

2. Description of the Prior Art

It is well known in the field of electrical connectors to utilize an actuating lever in order to ease the mating of complementary connectors through mechanical advantage. Typically, the actuating lever is incorporated into one half of a mating connector pair and includes a feature for co-operating with a complementary feature on the other half of the mating connector pair. Upon actuation of the lever, the feature of the lever and that upon the complementary connector interact, thereby drawing the two halves of the connector pair together. There are two relatively common co-operating features that are used to draw the connector pair together. The first feature utilizes a camming groove and a cam follower. The actuation of the lever produces relative movement therebetween, thereby drawing the connector pair together. The second feature utilizes a gear rack and meshing gear pinion such that movement of the lever results in cooperation therebetween in order to bring the connector pair together.

The one feature that both of these styles of actuation have in common is that the actuation lever needs a pivot point with the housing in order to define the rotation of the lever. This is accomplished in various ways. For example, it is known to incorporate holes in both the connector and the lever which is attached thereto by inserting a pin through these holes. It is also known to incorporate a pin onto either the actuating lever or the connector housing and a hole in the other so that when the pin is positioned in the hole, the pivot point is established. In normal situations, both the hole and pin are visible and enable easy assembly of the actuating lever to the connector housing. However, in some cases, for example when the mated connectors must be sealed from outside contamination, it is necessary that the lever must be assembled to the base connector in such a way that the location of the pin and hole are no longer visible. Without this visibility, it becomes very difficult to easily assemble the actuating lever to the base connector in the quick and efficient manner for volume product.

In U.S. Pat. No. 5,463,912 a solution for this problem is disclosed for situations where the pins are disposed upon the actuating lever. The connector housing includes a basic hood portion surrounded by an outer wall that includes the pivot defining holes for receiving the pins on the lever. The lever is a U-shaped member having opposing lever arms upon which the pins have been formed. These lever arms are to be received within a channel defined between the hood portion and the outer wall. The problem described above is solved by incorporating a groove in the outer wall that receives the pin and during insertion of the lever into the channel. The groove both deflects the lever and guides the pin towards the hole so that upon reaching the hole the resilience of the lever arm biases the pin into the hole, thereby establishing the pivot point. This solution is satisfactory for cases where the pin is incorporated and to the lever arm.

However, there are various situations when it is necessary or desirable to incorporate the pin in the housing, so that now the pin, not the hole is located on the outer wall and within the channel. In this situation, the confines of the channel are relatively small further reducing the ability to see the location of the pin therein to align the hole in the lever therewith. Additionally, it is necessary to deflect the arms of the lever so that the ends of the arms as they are being inserted into the channel clear the pin. Even after this is accomplished with the lever in the channel and further blocking an assembler's visibility, it is still necessary to align the pin and the hole, which are relatively closely dimensioned.

This problem is solved by providing both guide and biasing features along a wall of a connector housing and corresponding complementary guiding surfaces and camming surfaces towards an end of the lever such that upon assembly of the lever with the connector the guiding surfaces co-operate to align the hole in the lever arm relative the pin and the biasing surfaces co-operate to deflect the arm of the lever such that the end thereof will pass over the pin.

It is an advantage of the invention that a lever incorporating openings to establish a pivot point with the base can be easily and reliably assembled therewith. It is yet another advantage of the invention that these features may now be easily moulded into the respective components. It is still yet another advantage that a relief feature is included as part of the lever so that the lever doe not interfere with the camming members during operation.

BRIEF DESCRIPTION OF THE DRAWINGS

FIG. 3 is a rotated view of the section of FIG. 2; and

DETAILED DESCRIPTION OF THE PREFERRED EMBODIMENT

Figure 1:
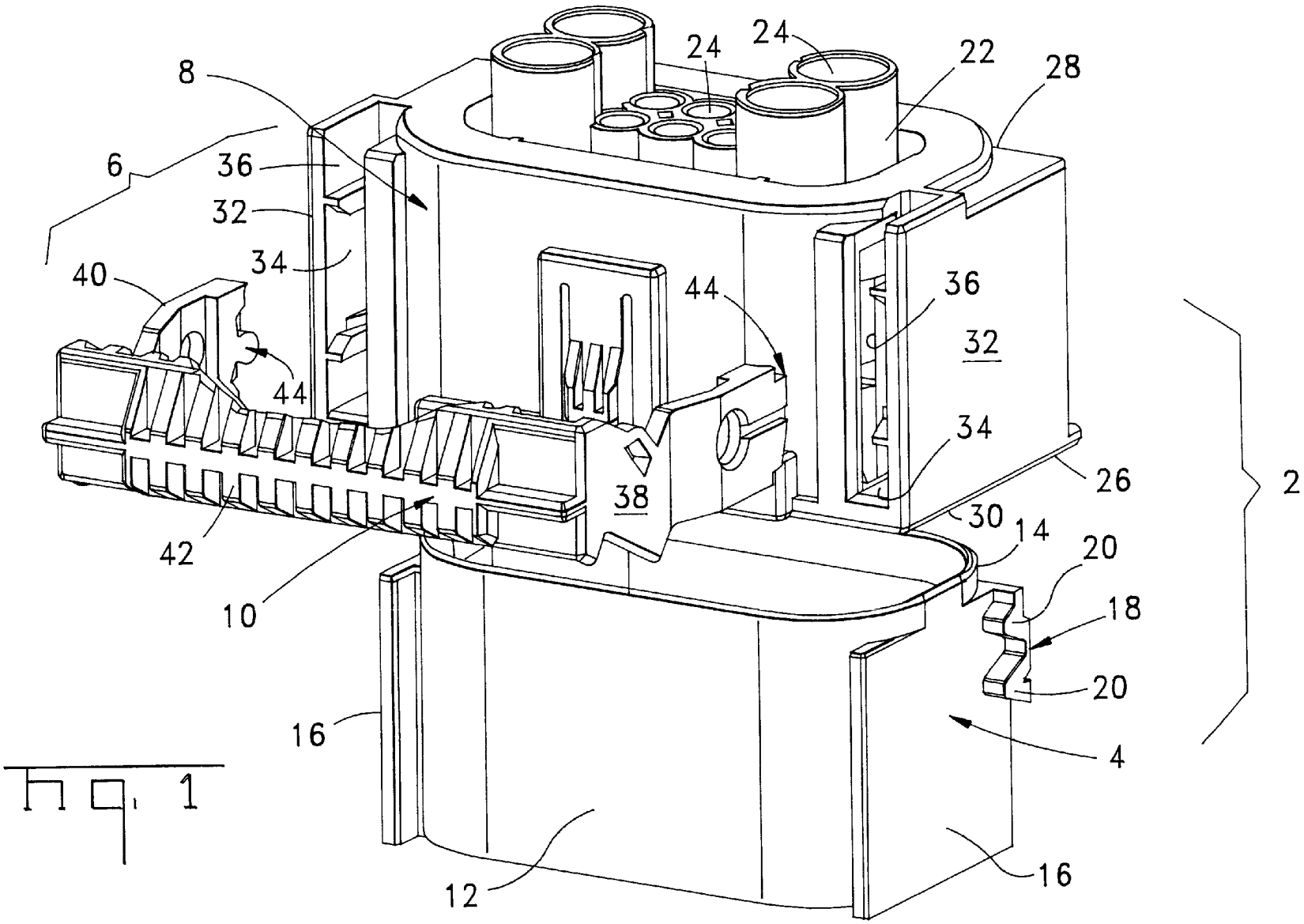
FIG. 1 is a partially exploded perspective view of an electrical connector pair incorporating the present invention prior to mating.

With reference now to FIG. 1, a connector pair including the present invention is shown at 2. The connector pair 2 includes a first connector 4 and a second connector 6. The second connector 6 comprises a base housing 8 and an actuating lever 10 for providing mechanical advantage in mating the first connector 4 and the second connector 6.

The first connector 4 includes an outer housing 12 having a shroud 14. Along opposite ends of the housing 12 are wall portions 16. A rack 18 having gear teeth 20 is attached to the wall portion 16. The first connector 4 can be a pin housing, a header, receptacle contact housing or any number of configurations and is illustrated here in representational form.

The base connector 8 of the second connector 6 includes a body portion 22 having contact receiving passageways 24 extending therethrough for receiving contacts (not shown) which would mate with corresponding contacts (not shown) in the first connector 4. The second connector 6 also includes mating face 26 into which the shroud 14 of the first connector 4 is received. An outer wall 28 generally surrounds the body portion 22 and is spaced therefrom such that an annular channel 30 is defined for receiving the shroud 14. The outer wall 28 includes outer end plates 32. In communication with the angular channel 30, is an actuating lever arm receiving cavity 34. These cavities 34 have a receiving opening 36.

The actuator 10 includes a pair of essentially identical opposing lever arms 38 and 40 that are joined together by a base 42. Each lever arm 38, 40 includes a gear tooth section 44 which is complementary with the teeth 20 of the rack 18 such that these complementary features interact in order to transfer the forces necessary to mate the connector pair. As mentioned above, it is well known to also use camming grooves and cam followers in place of the complementary gearing structure 18, 44 described herein. Use of the camming structure and any other structure to accomplish the same goal is fully recognized as an equivalent and may be utilized with this invention.

Figure 2:
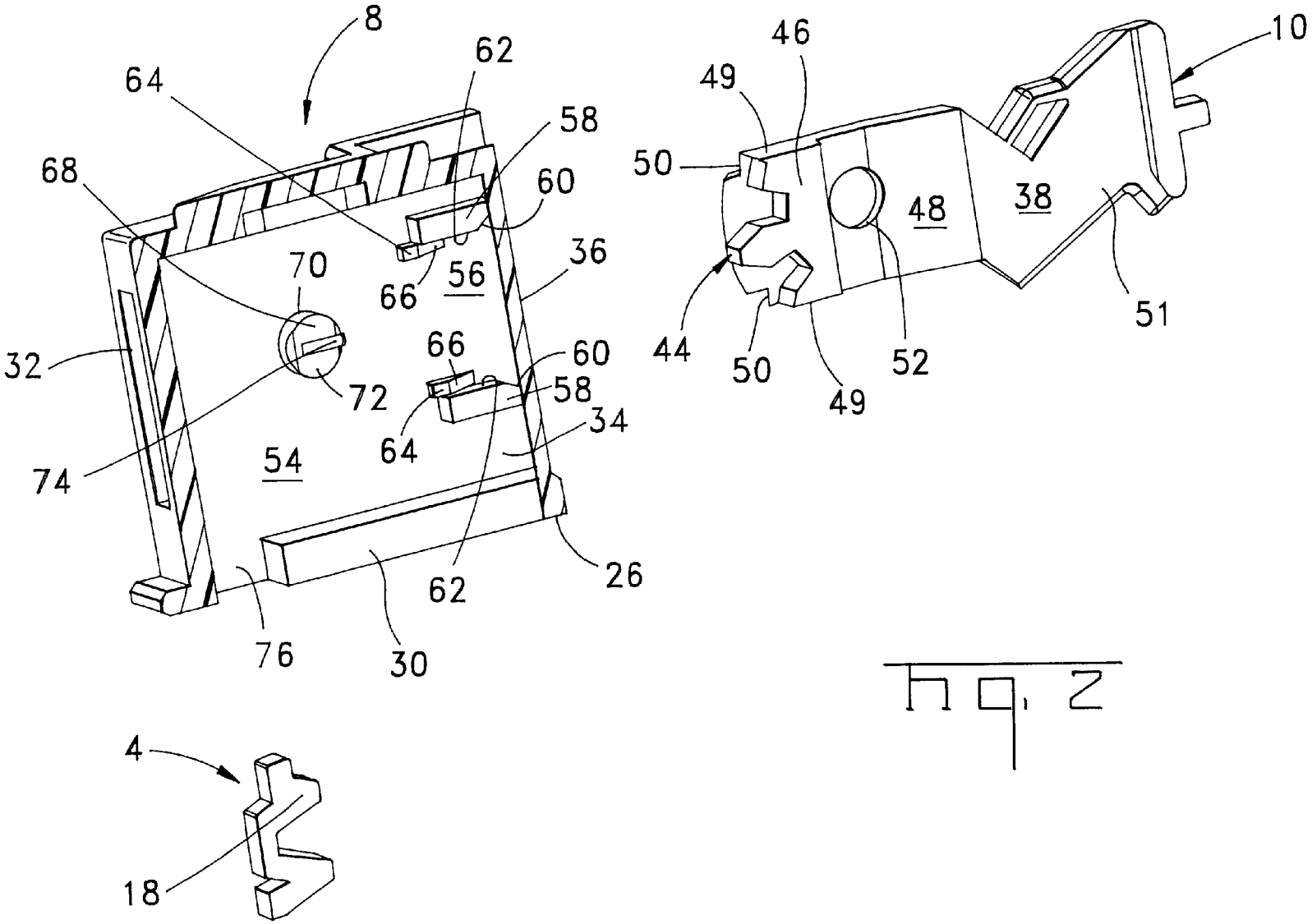
FIG. 2 is a sectional view taken along lines 2—2 of FIG. 1.

With reference now to FIG. 2 the important features of the present invention will be described in detail. First, the lever arm 38 of the actuator 10 includes a forward portion 46, an angled offset portion 48 and a rear portion 51. The angled offset portion acts as a relief feature enabling the lever to move freely once mounted to the connector as will be described below. A pivot hole 52 is provided towards the forward portion 46. The forward portion 46 further includes guiding surfaces 49 on either side of the hole 52. Additionally, the forward portion 46 includes biasing surfaces 50.

With respect now to the base housing 8, the lever arm receiving cavity 34 and associated features will be described in detail. The lever arm receiving cavity 34 is defined by an interior wall 54 of the end wall 32 and is in communication with the mating face 26 through the angular cavity 30 for receiving the shroud 14 and the associated wall 16. The receiving opening 36 includes a mouth 56 defined by a pair of guides 58 having lead-in tapers 60. The guides 58 also include tapered guiding surfaces 62. Additionally, disposed upon the interior wall 54 between and adjacent the guides 58 are cams 64. These cams 64 include camming surfaces 66. A pivot pin 68 is also disposed upon the interior wall 54 and is aligned with the guides 58 and cams 64. The pivot pin 68 has a cylindrical periphery 70 and a top surface 72 which includes a key 74 extending therefrom. The key 74 being aligned with the guiding surfaces 62 of the guides 58. As can further be seen, the angular channel 30 for receiving the shroud 14 of the first connector 4 includes a notch 76 wherein the rack 18 of the first connector 4 would be received.

With reference now to FIG. 3, where the view is taken from the opposite side of that shown in FIG. 2, details of the base connector 8 and actuator 10 will be further described. With reference the lever arm 38, a guide groove 78 extends between a front end 80 and the hole 52. A large taper 82 surrounds the hole 52 and a forward taper 84 is disposed toward the front end 80 of forward portion 46. Both tapers 82, 84 transition from an outer surface 86 of the lever arm 38 wherein the groove 78 is formed. Towards the front end 80 of the groove 78 an open receiving region 88 is also formed.

Figure 4:
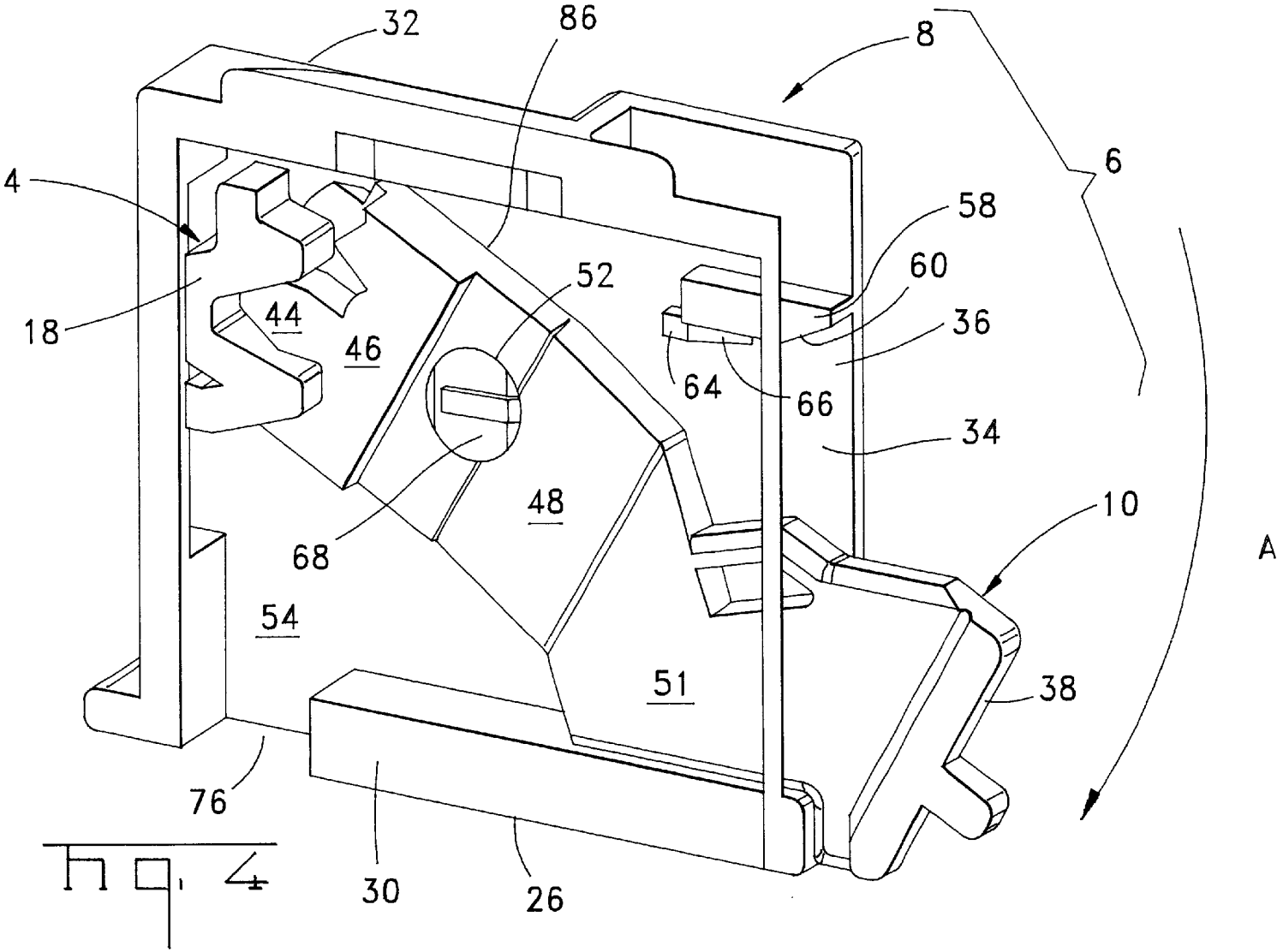
FIG. 4 is an assembled sectional view taken along the line corresponding to that used in FIGS. 2 and 3 showing the initially mated position.

With reference now to FIG. 4, the actuator 10 is shown within the base housing 8 of the second connector 6 and fully engaged with the rack 18 of the first connector 4. In this fully assembled position, the hole 52 in the lever arm 38 is positioned about the pin 68, thereby establishing a pivot point through which the lever aim 38 is moved in the direction of arrow A to effect mating. As can be seen, by way of the angled middle portion 48 of the lever aim 38, which acts as relief so that the arms can resile once the hole and pin align, the outer wall 86 of the front portion 46 is disposed generally against the inner wall 54 of wall 32. The rear portion 51 of the lever 32 is offset therefrom sufficiently so that there is no interference with the cams or guides 58. This enables the actuator 10 to be displaced without interference.

With reference now to FIG. 1–4, assembly of the actuating slide 10 with the base housing 8 will be described in detail. It is important to note, the aforegoing description allies to each of the arms 38, 40 and respective ends of the base connector 8. As can be seen in FIG. 1, the actuating slide 10 is U-shaped and contains arms 38 and base 40. The actuating member 10 in this embodiment is in moulded piece which has some resilience at the free ends of the arms 38, 40. With reference to FIG. 2, as each arm 38, 40 is inserted into channel 36, the guide surfaces 49 of each arm 38, 40 are received between guides 58 and the associated guide surfaces 62 aligning the hole 52 or arm 38 with the respective pin 68. The camming guides 50 correspond with the camming surfaces 66. The front end 80 (FIG. 3) co-operates with the camming surfaces 66 of cams 64 such that the forward portions 46 of each lever 38, 40 are deflected inward (away from interior wall 54) so that, upon further insertion of the actuating lever 10, key 74 is received in guide slot 78 and the outer surface 86 rides over the top 72 of the pin 68 until hole 52 corresponds therewith. When the hole 52 and the pin 68 correspond, the resilience of the arms 38 will result in the hole pin 68 being positioned in the hole 52 and the pivot being established. The chamfered front end 84 and the tapor 82 around the hole assist in guiding the corresponding surfaces.

We claim:

1. An electrical connector comprising:

an actuating lever for mating the electrical connector with a complementary connector, the actuating lever including a forward portion and a rear portion, an angled offset portion extends between the forward portion and the rear portion, the forward portion having a deflectable lever leg with a pivot hole therethrough, the pivot hole having a tapered surface provided about the circumference thereof;

a connector housing having a wall with a pivot pin extending therefrom and being receivable within the hole of the deflectable lever leg to establish a pivot for the actuating lever;

guide members and cams are positioned on the connector housing and are aligned with the pivot pin;

guide surfaces and camming surfaces are positioned on the actuating lever, the guide surfaces and camming surfaces are complementary to respective guide members and cams of the connector housing;

the angled offset portion provides the resilience required for the deflectable lever leg and offsets the rear portion relative to the first portion a sufficient distance to avoid the guide members and cams when the actuating lever is moved between a first position and a second position;

whereby as the actuating lever is inserted into the connector housing, the deflectable lever leg is resiliently displaced to move over the pivot pin, and as insertion continues the tapered surface cooperates with the pivot pin to guide the pivot pin into the pivot hole and allow the deflectable lever leg to resiliently return to its unstressed position thereby maintaining the actuating lever in the connector housing.

2. The electrical connector of claim 1 wherein the pivot pin includes a key and the deflectable lever leg includes a guide groove extending from the front end to the hole.

3. The electrical connector of claim 1 wherein the wall of the connector housing defines a portions of a channel for receiving a shroud of the mating connector.

* * * * *